US009051718B2

(12) United States Patent
Schmidt

(10) Patent No.: US 9,051,718 B2
(45) Date of Patent: Jun. 9, 2015

(54) MACHINE WITH A SWIVEL AND WIRELESS CONTROL BELOW THE SWIVEL

(76) Inventor: Stephen T. Schmidt, Eatonville, WA (US)

( * ) Notice: Subject to any disclaimer, the term of this patent is extended or adjusted under 35 U.S.C. 154(b) by 896 days.

(21) Appl. No.: 12/802,717

(22) Filed: Jun. 14, 2010

(65) Prior Publication Data

US 2010/0256837 A1 Oct. 7, 2010

Related U.S. Application Data

(63) Continuation-in-part of application No. PCT/US2009/038711, filed on Mar. 29, 2009.

(51) Int. Cl.

| | |
|---|---|
| ***E02F 3/96*** | (2006.01) |
| ***E02F 3/32*** | (2006.01) |
| ***E02F 3/43*** | (2006.01) |
| ***E02F 3/84*** | (2006.01) |

(52) U.S. Cl.

CPC ..... *E02F 3/964* (2013.01); *E02F 3/325* (2013.01); *E02F 3/432* (2013.01); *E02F 3/437* (2013.01); *E02F 3/841* (2013.01)

(58) Field of Classification Search

USPC ..... 701/2, 50; 172/25, 518; 37/403, 417, 37/443, 446, 903

See application file for complete search history.

(56) References Cited

U.S. PATENT DOCUMENTS

| | | | | |
|---|---|---|---|---|
| 6,119,054 | A * | 9/2000 | Miki et al. | 700/275 |
| 6,317,676 | B1 * | 11/2001 | Gengler et al. | 701/82 |
| 6,662,881 | B2 * | 12/2003 | Domann | 172/272 |
| 6,947,819 | B2 * | 9/2005 | Nelson et al. | 701/50 |

* cited by examiner

*Primary Examiner* — Richard Camby
(74) *Attorney, Agent, or Firm* — Jeffrey T. Haley

(57) ABSTRACT

An auto-powered mobile machine with controls for a riding operator and a system for carrying and making efficient use of a variety of attachable tools. Wireless radio communication from the controls to a lower tool may allow the swivel to spin any number of times without limitation. Hydraulic tool position controls are wirelessly coupled to a remote sensor that responds to a string datum line, a curb, direction of gravity, or GPS data.

10 Claims, 9 Drawing Sheets

MACHINE WITH A SWIVEL AND WIRELESS CONTROL BELOW THE SWIVEL

This application is a continuation in part of PCT/US 2009/038711 filed Mar. 29, 2009.

BACKGROUND

Machines originally designed as front end loaders with tracks or wheels, whether having skid-steering wheels or turnable wheels, such as Bobcat brand machines, have been adapted to become general purpose tool carriers that can receive a variety of controllable tool attachments to be attached to the front or back of the machine and controlled by an operator sitting in the operator's seat. This tool attachment carrying system can be improved upon. So that the swivel can rotate without limitation, electrical control signals may pass via wireless radio signal to the tool. The tool may be hydraulically adjusted in response to a sensor that senses the earth, such as location of a string datum line or a curb or gutter or GPS coordinates. The adjustment may move the tool vertically without pivoting to stay plumb or it may pivot the tool about a pivot point.

In the commonly available prior art, a central controller communicates with remote controllable actuators by switchable wired electronic communications or by multiple hydraulic lines coming from a controlled multiport hydraulic valve. These solutions require either expensive additional hydraulic lines which are subject to failure, or an electric wire running from the controller to the controllable electronics near the remote actuators, which wire is likely to be damaged during rough use of the heavy equipment on which it is mounted. The wire is susceptible to weather. The wire can get caught on branches and other obstacles. The wire can melt when touching the exhaust stack.

Where the controller receives position information from a terrestrial position sensor, there are two sets of wires subject to damage: those from the sensor to the controller and those from the controller to the actuators. This problem is particularly severe where the cab swivels and the actuators are mounted below the swivel, as the wires then need to pass through contact rings on the swivel to allow the cab to swivel without limitation.

SUMMARY OF THE INVENTION

The invented solution is to replace both of these sets of wires with two (or three) wireless radio transceivers that carry both the terrestrial sensor information to the controller and the control information to the actuators. The remote transceiver(s) get their power from a battery, which may be charged by a generator powered from hydraulic fluid flowing to an actuator.

The machine may be an excavator, particularly a mini-excavator. So that the swivel can fully swivel any number of rotations without limitation, the system may include an electrical circuit coupling the controls with the moving parts of the mounting support for the tool. The control signals may be communicated with a wireless link that carries radio communications from the controls to the mounting support or the tool. In this case, electrical power to operate a wireless communication component coupled to the mounting support or tool may be provided by a hydraulic generator which receives power from flow of hydraulic fluid passing through the swivel from a hydraulic pump on the engine mounted above the swivel.

The swiveling tool may be an earth moving bucket or a claw or a rake or vibratory compactor or any similar implement. The first and second linear acting tools may be any of: a curb and gutter grading blade; a curb and gutter extruder; a sidewalk and shoulder grading blade; an asphalt paver; a concrete paver; a fence installer; a trencher; a concrete/asphalt saw; a side roller/compactor; a vibratory roller; a snow plow; and other similar tools.

The tool carrying and controlling machine may further include a hydraulic actuator coupled to the mounting support and configured for adjusting the support or an attached linear acting tool in response to a control, which may be an operator control or an automated control that responds to location relative to a string datum line or that responds to a slope sensor or that responds to position with respect to global positioning system satellites.

A curb and gutter extruder may further comprise a hydraulic actuator coupled to a hydraulic valve that is automatically controlled by a controller that adjusts height of the extruder relative to one of: location with respect to a datum line string, tilt with respect to gravity, or location with respect to global positioning system satellites.

A sidewalk grading machine may further comprise a sonar position detector that detects position of a datum line relative to the detector which detected information is used to adjust the vertical adjusting component. The datum line may be a string or a concrete curb or gutter or a laser line or plane, a road surface, or an established grade.

Figure 4A:
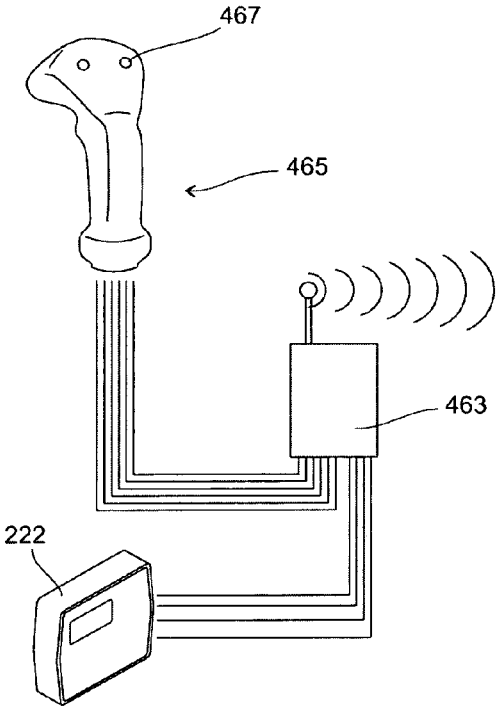
FIG. 4 shows wireless components for controlling a detachable tool from the cab.

Originally filed informal FIG. 4*a* in the parent application included the following text which is omitted from formal FIG. 4*a:*

Beside the handgrip control:

SureGrip Inputs

1. Extension Out
2. Extension In
3. Wheel Up
4. Wheel Down
5. Komatsu Blade Up
6. Komatsu Blade Down Beside the Topcon user interface display box:

2 way communication

The Topcon receives a signal from the slope sensor (The communication is a proprietary protocol on an RS-485 port).

It in turn drives the Danfoss proportional valve on the SGS tool.

20% of system voltage shifts the spool to maximum one way

50% of system voltage is neutral

80% of system voltage shifts the spool to maximum the other way

Figure 4B:
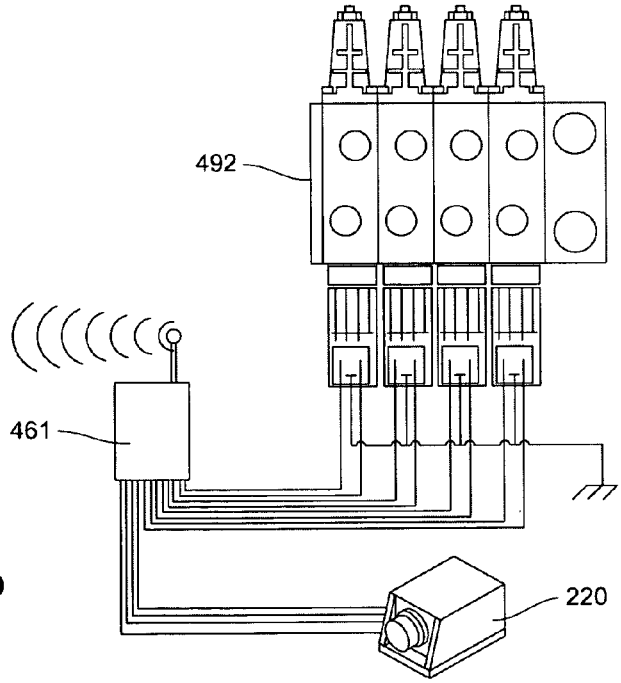

Originally filed informal FIG. 4*b* included the following text which is omitted from formal FIG. 4*b:*

Beside the Danfoss multiport proportional valve:

Outputs

1. Extension Out
2. Extension In
3. Wheel Up
4. Wheel Down
5. Komatsu Blade Up
6. Komatsu Blade Down
7. Slope Proportional On the valve port blocks, left to right:

Extension, Wheels, Slope Proportional, Komatsu Blade, Inlet

Beside the slope sensor with a control knob:

Slope Sensor (4 wires)

12 Volt Power

Ground 2 communication

The communication is a proprietary protocol on an RS-485 port

On the wires to the slope sensor:

2 way communication

DETAILED DESCRIPTION

The Prior Art

Figure 1:
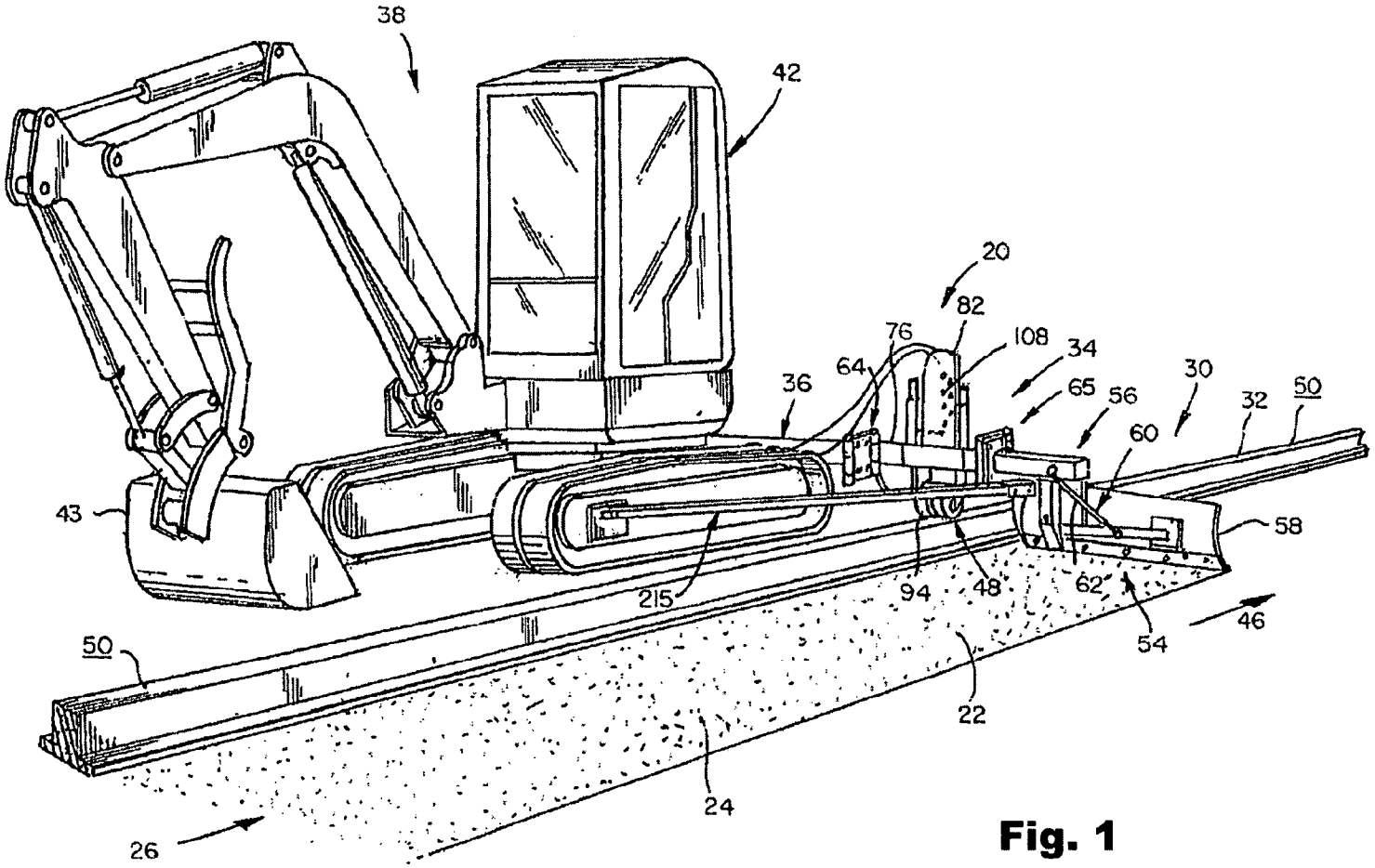
Fig. 1 (PRIOR ART)
FIG. 1 shows a prior art sidewalk grader.

Referring to FIG. 1 of the drawings which shows the prior art sidewalk grading machine, numeral 20 generally designates the sidewalk grading blade and support structure, called the sidewalk grader 20. The sidewalk grader 20 is used to grade sidewalk base material 22, which sometimes includes crushed rock 24, to a predetermined specified grade and elevation to form the base 26 of a designed sidewalk (not illustrated). Typically, the sidewalk grader 20 accommodates grading activity for sidewalks that extend adjacent to and along an existing road structure 30 of the type that incorporates a curb 32 as a border.

More specifically, the sidewalk grader 20 comprises a tracking assembly 34 adapted for fixable engagement with a vertically movable accessory 36 extending from below the swivel in a piece of construction excavation equipment 38. Commonly, a vertically adjustable backfill blade extending from a common compact excavator 42 is effective 36 for this purpose. When a compact excavator 42 is used, the bucket 43 thereof, can be very useful to either remove or add additional sidewalk base material 22 depending on the condition of the site reserved for the sidewalk. In addition, as the sidewalk grader 20 advances along the road structure 30, the bucket 43 can be used to break-up native hard-pan type soil, and to remove large rocks and the like.

The construction equipment 38 is generally positioned to move forward over an existing road structure 30 to advance the sidewalk grader 20 in a direction along the existing road structure 30, substantially parallel thereto. This forward movement is indicated by arrow 46. Importantly, the excavation equipment 38 so provided is disposed and operated over an existing road structure 30 thereby minimizing the impact it has on the base 26. Accordingly, the tracking assembly 34 is configured to extend from the vertically movable accessory 36 in a transverse direction to the course of advancement (indicated by an arrow 46), transversely across the road structure 30 and the curb 32 thereof.

In addition, the tracking assembly 34 further comprises a vertically adjustable tracking means 48 disposed for engagement with the top surface of the curb 32 portion of the road structure 30. With this configuration, the top surface 50 of the curb 32 provides a point of reference for operation of the sidewalk grader 20.

A grading assembly 54 is mounted and fixed to the tracking assembly 34 so that the grading assembly 54 extends outward, beyond the curb 32, positioned over the location of the area reserved for the designed sidewalk and base 26 thereof. More specifically, the grading assembly 54 comprises a frame 56, and a grading blade 58 rotatingly mounted to the frame 56 to permit adjustment of slope of the grading blade 58 according to the specified sidewalk design grade. In order to lock or fix the rotation of the grading blade 58 in relation to the frame 56, according to a predetermined grade, a fixing means 60 for fixing the blade rotation is provided.

As noted above, the tracking means 48 is vertically adjustable. This feature is provided to enable the tracking means 48 to engage with the top surface 50 of a curb 32 to provide a relative reference, or point of reference, for precise vertical and horizontal adjustment of the sidewalk grader 20, to position the grading assembly 54, and for maintaining the grading assembly in the desired position in relation to the curb as the sidewalk grader 20 advances along the existing road structure 30 as indicated by arrow 46.

Because the top surface 50 of the curb 32 is usually rough concrete, the preferred tracking means 48 is constructed for rolling engagement along the top surface 50 of the curb 32, such as a wheel 94.

In a simplified embodiment of the sidewalk grader 20, the tracking assembly 34 comprises a pivot joint 64, disposed adjacent the backfill blade to enable the sidewalk grader 20 to fold from a first unfolded position to a folded position. An additional pivot joint 65 is provided to form an additional folding point to fold the sidewalk grader 20 for storage and transportation. As will be discussed more fully below, a second pivot joint 65 can provide an additional pivot axis for up and down movement of the grading assembly 54 to provide greater flexibility thereof.

A cylinder support 82 is fabricated from solid steel for strength and is welded directly to the support tube 76. At the top of the cylinder support 82 is an upper eye to provide a connection point for the upper portion of a vertical hydraulic cylinder. Similarly, at the opposing end, its ram is connected to a vertically movable wheel carriage having a wheel 94. With this arrangement, the ram 88 can be operated to vertically adjust the wheel 94 to the proper elevation to rest on the top surface 50 of curb 32 to track the curb 32 as the sidewalk grader 20 advances along the road structure 30. Adjusting the vertical hydraulic cylinder causes pivoting of the blade 58 rather than vertical movement of the blade.

As the sidewalk grader 20 advances along the road structure 30, the wheel 94 should be adjustable between a first lower limit and a second upper limit, thereby lowering the sidewalk grader 20 to enable the sidewalk grader 20 to follow the curb 32 as it drops to an area reserved for a driveway (not illustrated), i.e., where the curb transitions downward and fades into the driveway. This movement causes pivoting of the blade 58 in an arc, such that its distant end moves more than its nearer end, rather than vertical movement of the blade.

Slope Sensor and Automatic Control

To compensate for the pivoting of the blade, a slope control system including a slope sensor 220, a pivot 180, and a hydraulic cylinder 226 (all not shown in FIG. 1) were added to the prior art system. The preferred slope sensor is the Topcon model number 9620. This slope control system compensates for any deviation in slope of the grading blade 58 caused by bumps in the road structure 30, change in slope of the road structure, and excavator load changes and the like.

Accordingly, the slope sensor 220 senses any change in slope and communicates the change via a wireless transmitter/receiver 461 to a control box 222 which then wirelessly signals an electronically controlled valve stack 492 to activate the hydraulic slope control link 226 to compensate for the change. A preferred control box is the Topcon model # 9164. The preferred wireless components at both ends of the wireless link are Cervis SmaRT wireless transceiving base units (model BU-216F-INT). These units carry both the signals from the slope sensor and the commands to the valve stack. In this way, the grading blade 58 is automatically controlled to provide a smoothly graded base 26 for the sidewalk.

Converting the Excavator to a Multi-Attachment Side Tool Carrier

Figure 2:
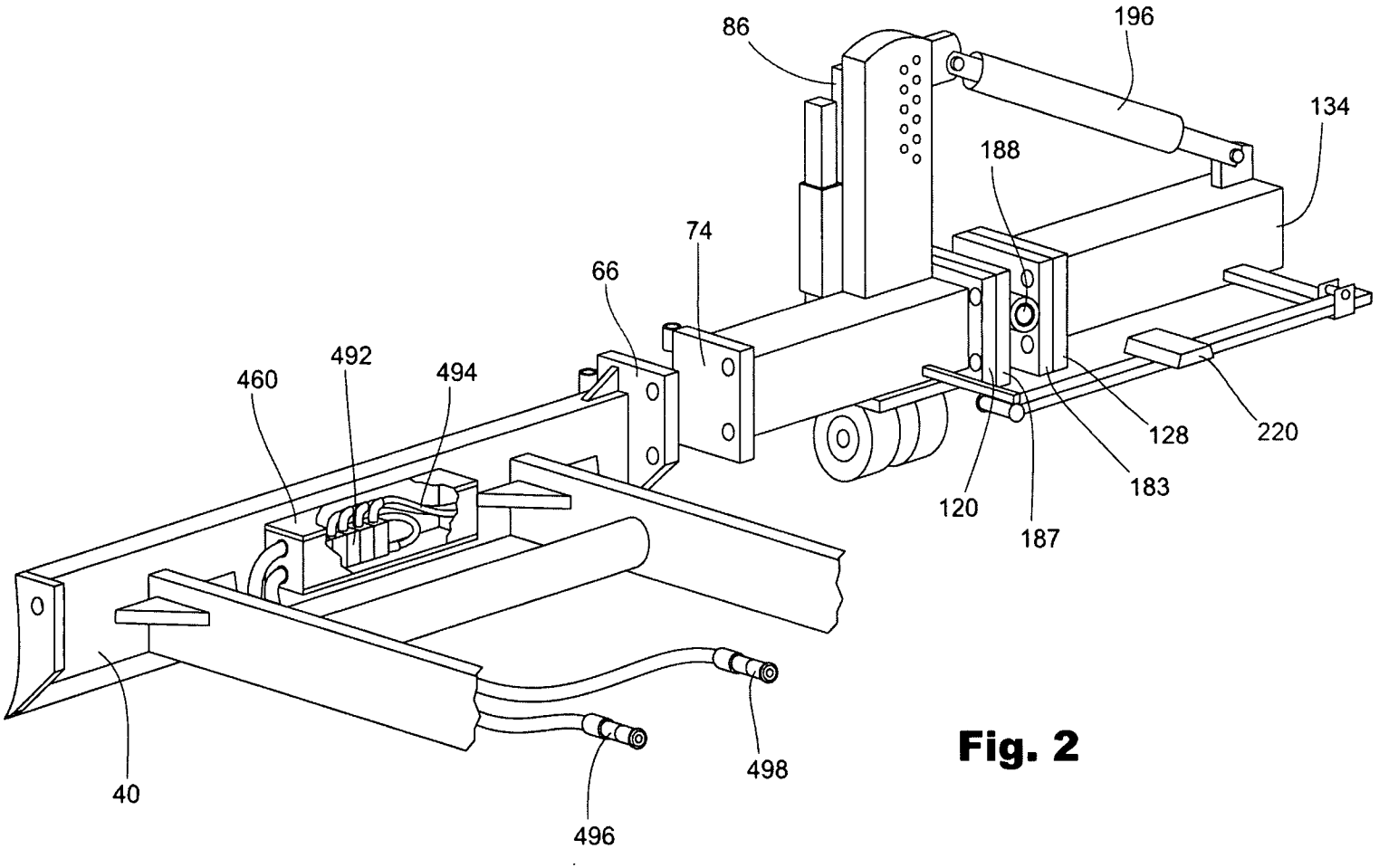
FIG. 2 shows a mounting base and tool's mating attachment surface.
Figure 3:
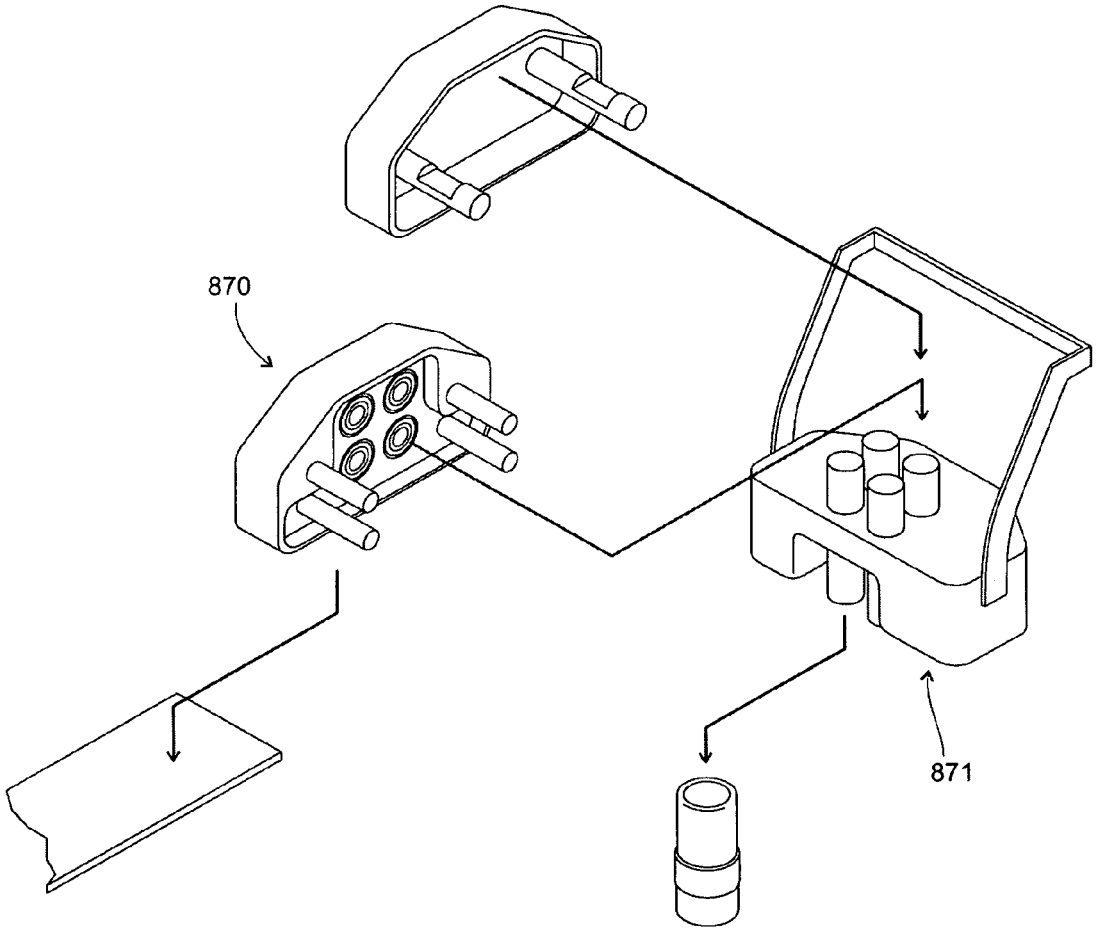
FIG. 3 shows a quick coupling component for coupling hydraulic lines to a detachable tool.

As described below, as an improvement over the above described prior art, the present invention encompasses a tool carrying and controlling system wherein an operator can control a swiveling tool and either a first attachable linear acting controllable tool or a second attachable linear acting controllable tool to operate in coordination with the first tool. For use in this system, the excavator is modified to include a side tool mounting base or support affixed below the swivel for attaching any linear acting tool, and a set of hydraulic line quick couplers 494 are mounted proximate to the side mounting base as shown in FIG. 2. The couplers maybe ganged as shown in FIG. 3. The quick coupler hydraulic connections may be color-coded to correspond to the function control buttons on a Suregrip handle 465 in the cab with corresponding colors as shown in FIG. 4*a*. Attachment hydraulic hoses may also have corresponding colors.

On the excavator, the two hydraulic hoses 496, 498 that operate the stock backfill blade are rerouted to an electronically controlled valve stack 492 with proportional and/or on/off sections for supplying hydraulic pressure to any number of attachment hydraulic circuits 494. Accordingly, the tool support mount on one end of the backfill blade is now connected to, and controlled by the valve stack. In this way, the operator can electronically control the valve stack 492 from within the cab of the excavator, above the swivel, to control all hydraulic circuits below the swivel that effect any attachment function. The valve stack 492 is located in a protective housing 460 between the lower side of the swivel and the quick couplers, and any number of hoses 494 are routed from the valve stack to the set of hydraulic couplers for the side attachment.

Electric control wires from the cab to the valve stack 492 may couple the two together as in the prior art. However, this limits rotation of the swivel and risks damaging the wires. An improvement is to pass the control wires through the swivel with slip rings, an electromechanical device that allows the transmission of power and electrical signals from a stationary to a rotating structure, also called a rotary electrical joint, collector or electric swivel.

Alternatively, A transmitter/receiver mounted in the cab can wirelessly transmit all commands from an installed control handle 465 mounted on the right or left joystick as well as any other switches or any controls in the machine's cab. A receiver/transmitter 463 capable of driving the hydraulic valve stack decodes the signal and controls the valve stack 492. A hydraulic generator that is installed in the return hydraulic line generates power to keep a large capacitor charged. This capacitor supplies power to operate the electric control valves and supplies power to the wireless receiver/transmitter module 461. A battery may be used instead of a capacitor. The battery can be charged as mentioned above or removed each night and charged the conventional way. A pair of rechargeable batteries similar to those used on a cordless drill can be used to power the wireless system below the swivel. A 12 volt charger can be used in the cab to recharge the spare and the batteries can be swapped when the battery in use runs low.

As another alternative, instead of manifolding one hydraulic circuit into many with a control valve stack placed below the swivel and then routing electric or wireless controls through or around the swivel, the excavator swivel can be modified to add more hydraulic circuits through the swivel, allowing the valve stack to be placed above the swivel.

For use with this multi-tool carrier, several linear acting attachable side tools are described below.

Curb or Curb and Gutter Extruder

Figure 5:
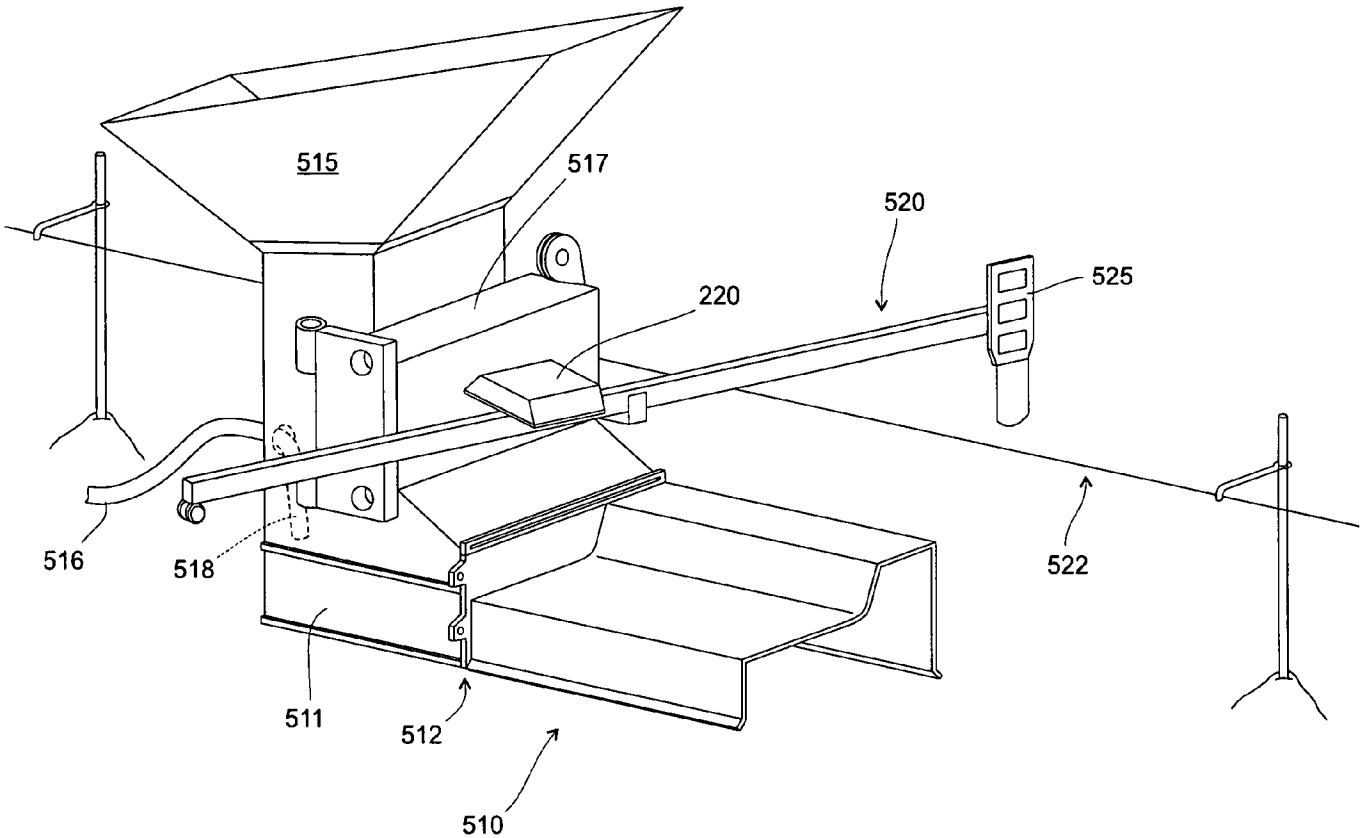
FIG. 5 shows a curb and gutter extruder.

On a road and sidewalk construction job, the first linear acting tool that is useful when mounted on the side tool carrier described above is a curb and gutter extruder as shown in FIG. 5.

Figure 6:
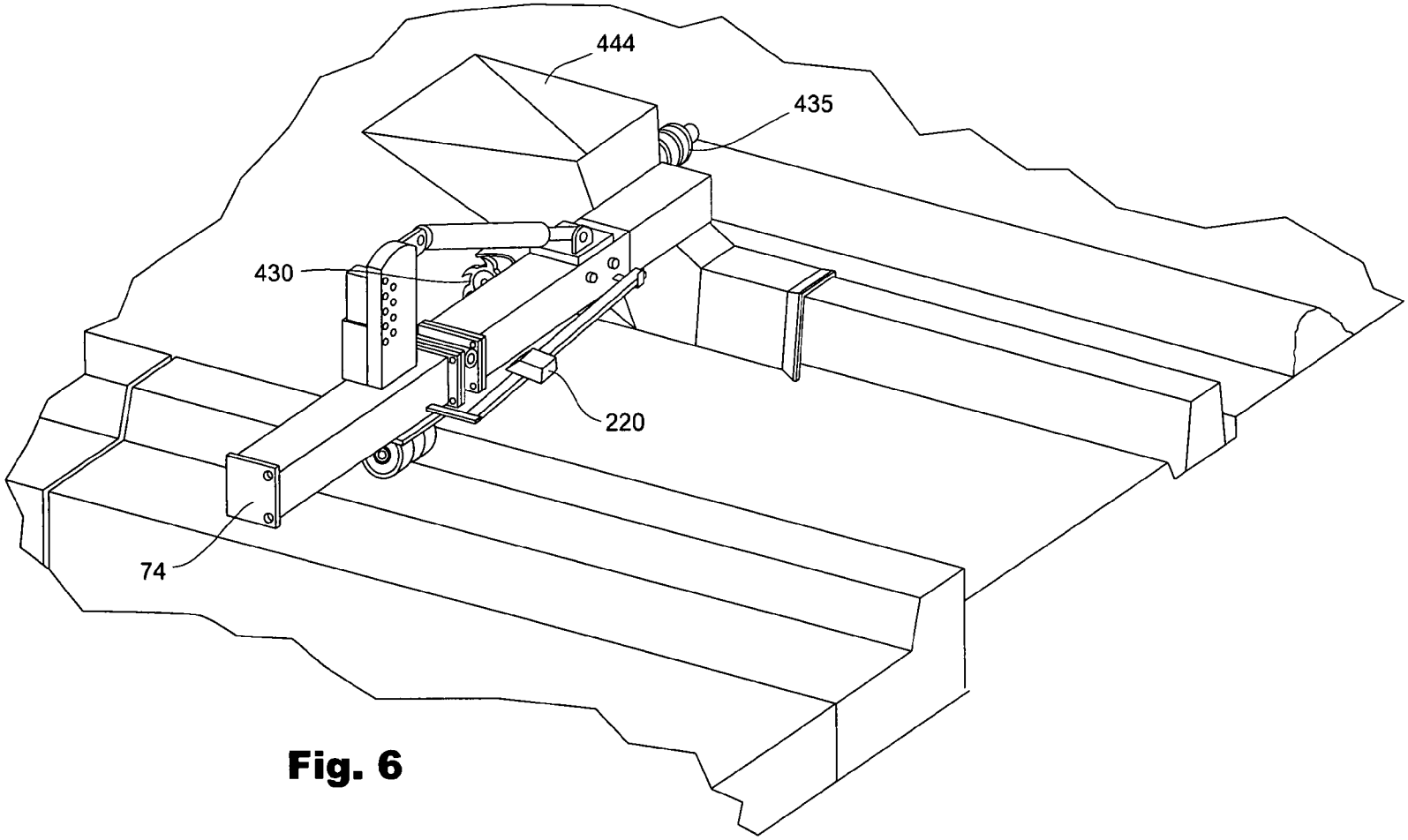
FIG. 6 shows an extruder for a second curb.

After a first curb is extruded and hardened, the extruder head may be changed to extrude a second curb on the far side of the sidewalk grade as shown in FIG. 6. A trimmerhead 430 and auger 435 can be used in conjunction with or ahead of the curb and gutter extruder.

As shown in FIG. 5, a sonar sensor 525 may be set up on an arm 520 to wirelessly actuate controllers that adjust height and lateral location relative to a string 522 set up as a datum line.

Sidewalk Grader Improvements

The next tool to be used on the job is a sidewalk grader. As an improvement to the prior art grader, the blade width may be made adjustable with a sliding blade extension 304 guided by guide bars 315 and 316 and actuated by a hydraulic cylinder 318 as shown in FIG. 7.

Figure 7:
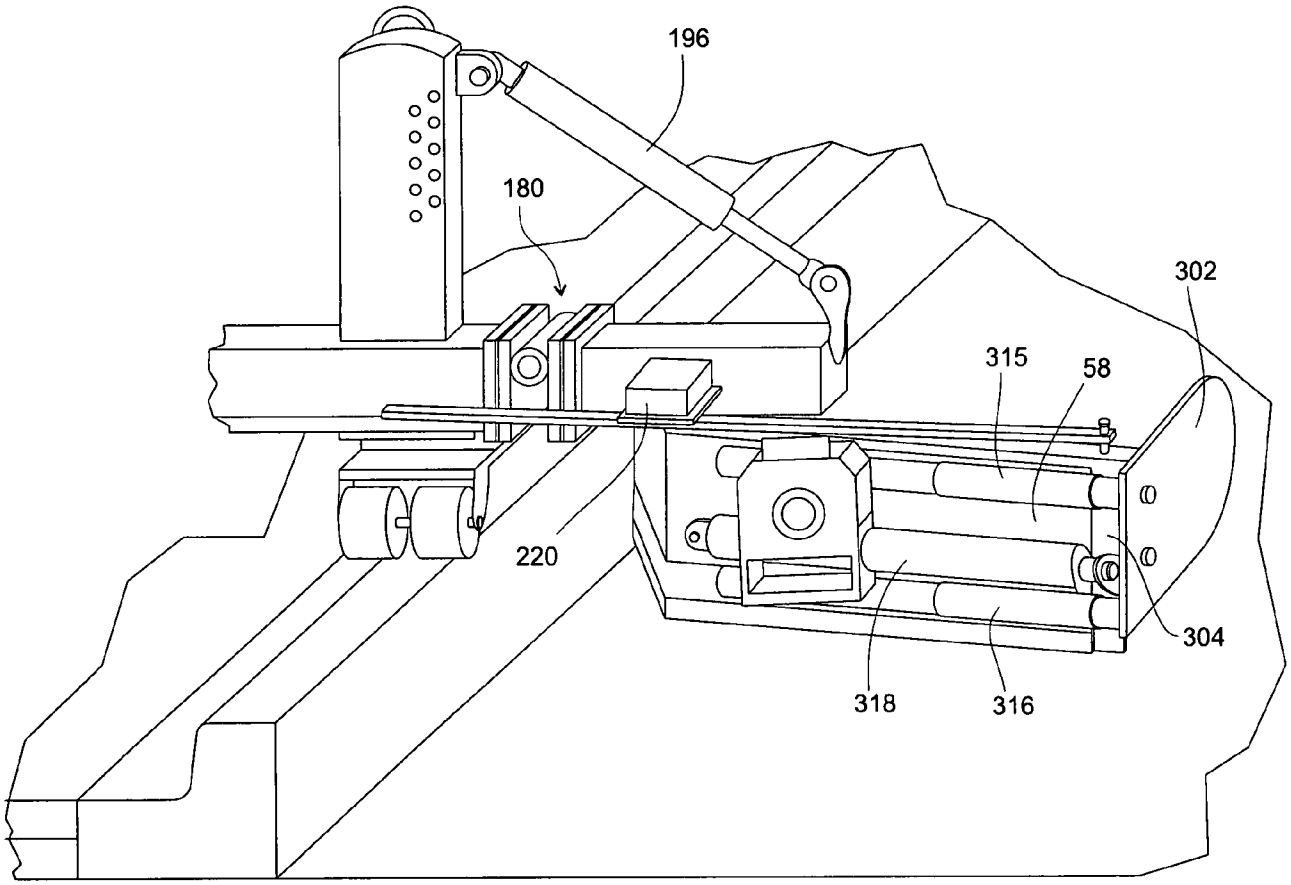
FIG. 7 shows a laterally extendable edge blade.

As another improvement, a detachable fin 302 shown in FIG. 7 may be added to the distant end of the blade.

Then a second curb may be extruded as shown in FIG. 6.

Also, a sonar sensing and guiding system may be added to sense the curb top or the gutter or a guide string. The preferred model is Topcon #9142. A laser sensor may be added to sense a laser beam for guidance.

Multi-Coupling Plate

FIG. 3 shows a fixed hydraulic multi-coupling plate 871 and a mating mobile hydraulic multi-coupling plate 870.

Figure 8A:
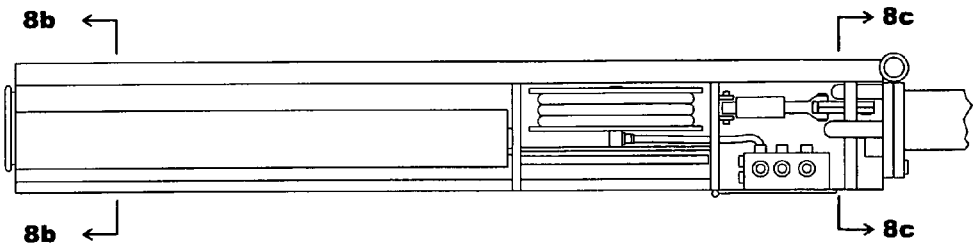
FIGS. 8 and 9 show a multi-coupling plate and retainers of the tool mount.
Figure 8B:
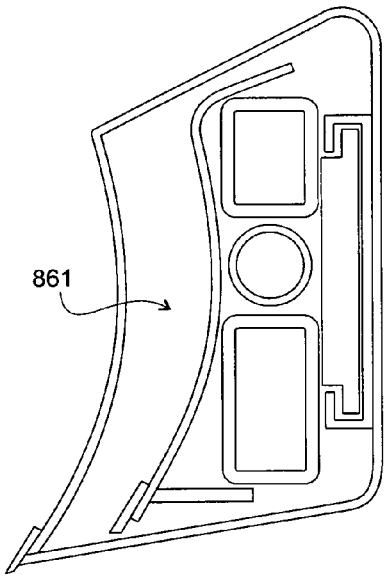
Figure 8C:
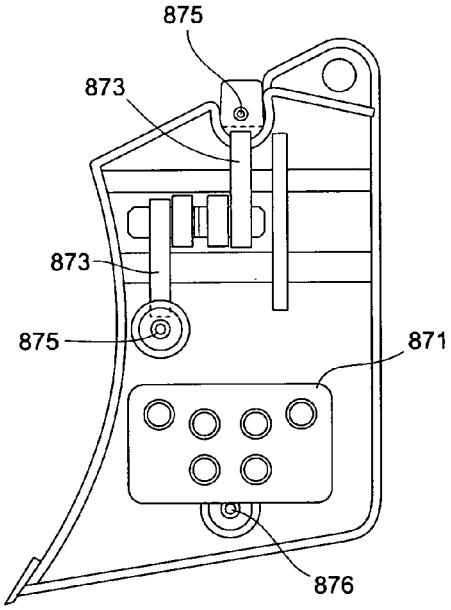
Figure 9A:
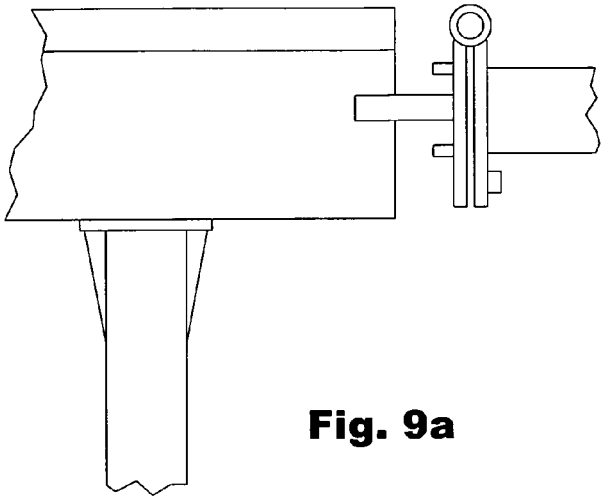
Figure 9B:
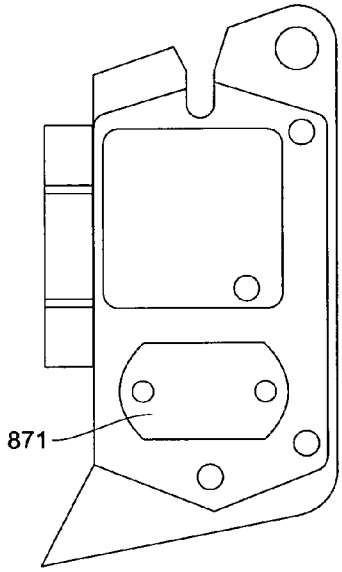
Figure 9C:
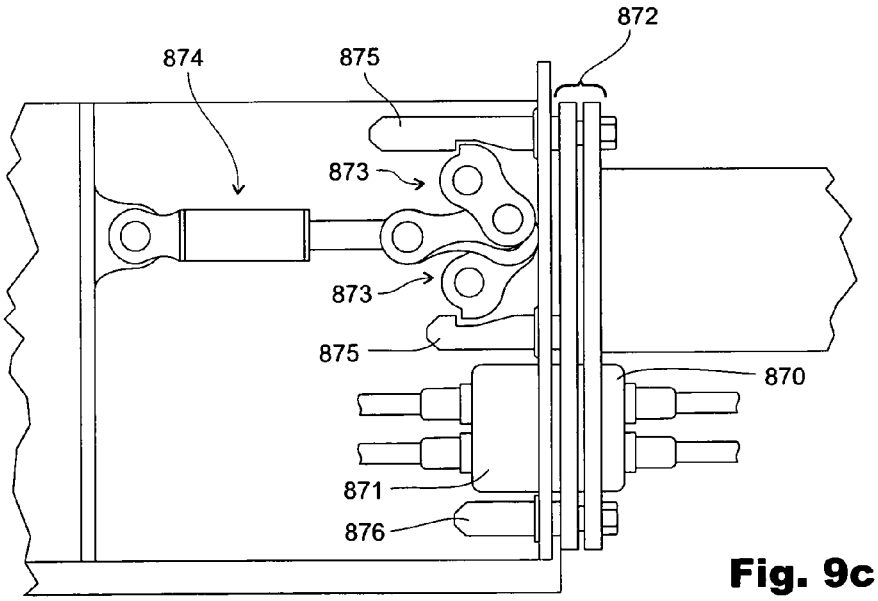

FIGS. 8*c*, 9*b*, and 9*c* show a multi-coupling plate 871 mounted on the tool mounting base (which is preferably also an earth moving blade). This prevents hydraulic hoses from being incorrectly coupled. As shown in these figures, it also is engaged by the action of engaging a tool mount 872 with a tool multi-coupling plate 870 onto the mounting base. Thus, one action both attaches the tool and couples hydraulic lines for actuating the tool.

FIGS. 8*c* and 9*c* show how retainers 873 of the tool mount may be powered with a hydraulic cylinder 874. The retainers 873 engage and retain steel pins 875 with are part of the tool mount 872. A third pin 876 may be added beside the multi-coupler to ensure alignment.

Red Zone Auto Controls

A system with a programmable controller in the cab with a custom graphic display can be used to create a "Red Zone" that the excavator components cannot enter, thereby protecting the tool and people near it or using it. Inclinometers, potentiometers, rotation sensors, and cylinder stroke sensors are some of the means to indicate to the controller the position of the cab, arm, boom, and bucket, to enable the machine to stay out of the "Red Zone". When the machine enters the "Red Zone" the pilot valve cuts the oil supply between the excavator control handles and the excavator control valve.

In particular, the controller can be programmed to give specific directions for each attachment using a look-up table for each attachment to specify:

location of "Red Zone", restriction on flow rate and psi of hydraulic oil to each hydraulic actuator, down to zero when appropriate, allowed characteristics of each function of each hydraulic actuator of the excavator or the tool, limitations on or specification of track speed and direction (the Leica Sonar system can read a string line and direct the controller to drive the machine's direction and speed automatically) as with the side grader and the curb and gutter extruder; and alignment of control handle buttons to correspond with attachment functions.

IFM Electronics makes a suitable inclinometer, model EC 2045, and cylinder stroke sensors. They also offer a suitable programmable controller, model CR 1050.

What is claimed is:

1. A mobile machine with a swivel and, above the swivel, an operator's seat and an engine that drives a hydraulic pump, where the engine and seat can fully swivel any number of rotations without limitation and the operator can control a hydraulically driven tool below the swivel, comprising:

(a) a set of wheels or tracks on which the machine rides supporting a support structure;

(b) coupled to and supported by the support structure, a vertical swivel such that components coupled to an upper side of the swivel can swivel about a vertical axis relative to the support structure any number of rotations without limitation;

(c) coupled to and supported by the upper side of the swivel, an engine that drives a hydraulic pump and an electrical generator, an operator's seat and operator's controls;

(d) coupled to and supported by the support structure and fixed to a lower side of the swivel, a hydraulically controllable tool;

(e) a wireless communication link that carries control communications from the operator's controls to at least one wirelessly actuatable electronically actuated hydraulic valve below the swivel which hydraulic valve effects control of the tool; and (f) a power source coupled to the electronically actuated hydraulic valve which power source provides electrical power to operate the hydraulic valve and to operate a wireless communication component coupled to the hydraulic valve.

2. The machine of claim 1 wherein elements (a) through (d) are provided by an excavator.

3. The machine of claim 1 wherein the wireless communication component comprises a radio link coupling the controls with the wirelessly actuatable hydraulic valve.

4. The machine of claim 3 wherein electrical power to operate the electronically actuated hydraulic valve and the wireless communication component is provided by a hydraulic generator which receives power from flow of hydraulic fluid from the pump driven by the engine through the swivel.

5. The machine of claim 1 wherein the tool is selected from the group comprising:

an in-front grading blade;
an on-the-side grading blade;
a curb and gutter extruder;
an asphalt paver;
a silt fence installer;
a post and fence installer;
a trencher;
a concrete/asphalt saw;
a concrete/asphalt planer;
a manhole cutter;
a log splitter;
a side roller/compactor;
a concrete pulverizer;
a stump grinder;
a three point hitch adapter;
a forestry mulcher;
a demolition shear;
a rocksaw;
a rock and concrete breaker
a brush hog;
a snowblower;
a rockhound;
a tree shear;
a dirt and rock sifter;
a vibratory roller;
a rotating broom;
a boring unit that drills vertically for installation of utilities;
a rotary saw like a saw blade;
a wheel saw with large teeth carried by a wheel like structure; and
a bedding hopper that would place utility trench bedding (sand) by tipping or conveyor.

6. The machine of claim 3 wherein electrical power to operate the wireless communication component or the electronically actuated hydraulic valve is provided by a battery.

7. The machine of claim 3 wherein electrical power to operate the wireless communication component or the electronically actuated hydraulic valve is provided by a capacitor.

8. The machine of claim 3 wherein electrical power to operate the electronically actuated hydraulic valve and the wireless communication component coupled to the electronically actuated hydraulic valve is provided by a power wire passing from above the swivel through the swivel to below the swivel.

9. The machine of claim 1 having a wirelessly actuatable hydraulic valve below the swivel which hydraulic valve effects control of at least two actuators of the tool wherein the actuators are hydraulically actuated and the commands sent from the receiver are sent to a multi-port hydraulic valve stack which controls flow of hydraulic fluid to each of the at least two actuators.

10. The machine of claim 9 wherein the hydraulic fluid sent to the actuators passes through quick-connect couplers for at least two hydraulic lines, allowing the tool to be disconnected and re-connected.

* * * * *